US005152325A

United States Patent [19]

Koch

[11] Patent Number: 5,152,325

[45] Date of Patent: Oct. 6, 1992

[54] HEDDLE TO SLIDE BAR ARRANGEMENT

[75] Inventor: Bernhard Koch, Horgenberg, Switzerland

[73] Assignee: Grob & Co. Aktiengesellschaft, Horgen, Switzerland

[21] Appl. No.: 734,668

[22] Filed: Jul. 23, 1991

[30] Foreign Application Priority Data

Jul. 24, 1990 [DE] Fed. Rep. of Germany ..... 4023512

[51] Int. Cl.[5] ..... D03C 9/06

[52] U.S. Cl. ..... 139/91; 139/93

[58] Field of Search ..... 139/93, 91, 92

[56] References Cited

U.S. PATENT DOCUMENTS

| | | | |
|---|---|---|---|
| 2,047,511 | 7/1936 | Kaufmann | 139/93 |
| 2,386,690 | 10/1945 | Kaufmann | 139/92 |
| 2,973,786 | 3/1961 | Kaufmann | 139/92 |
| 2,991,810 | 7/1961 | Stephens | 139/92 |
| 3,209,789 | 10/1965 | Munch | 139/93 |

*Primary Examiner*—Andrew M. Falik

*Attorney, Agent, or Firm*—Watson, Cole, Grindle & Watson

[57] ABSTRACT

A heddle is held at one single end section in a heddle frame having a single supporting member, the heddle being held by the provision of a groove-shaped opening to engage a slide bar of the supporting member with little play relative thereto. Another groove-shaped opening of the heddle at its one end section can be provided to engage an auxiliary slide bar on the supporting member with much more play relative thereto. The opposite, non-driven terminal end of the heddle is formed as a guide element to enable the automatic drawing-in of the warp threads. In addition, such guide element functions to line up the plurality of heddles present in the heddle shaft by the provision of a rod-shaped body which extends through aligned openings in the guide elements of the heddles, so as to prevent the heddles from shuttling back and forth in the weaving operation, and from mutually snagging at their terminal ends.

8 Claims, 1 Drawing Sheet

HEDDLE TO SLIDE BAR ARRANGEMENT

RELATED APPLICATION

This application relates to U.S. Ser. No. filed even date herewith and entitled "Heddle Shaft," commonly owned herewith.

BACKGROUND OF THE INVENTION

This invention relates to a heddle having at least one thread eye for the shed formation on a weaving machine carried out by a plurality of heddle frames which support a number of such heddles and all capable of oscillating movements, each of the heddle frames having only a single heddle supporting member capable of being driven by the respective heddle frame thereof to form the shed. More particularly, each heddle is supported at only one end section thereof to the supporting leaving the opposite end of the heddle fall.

Heddles of known designs and of various materials are in use. They are typically provided with two attachment ends designed as closed or open hook-shaped end hooks for attachment to the heddle frame. The heddles are usually lined up with their hook ends on the heddle slide bars, which are arranged fixedly or detachably at the supporting members of the heddle frame. The lining up of the heddles on heddle slide bars facilitates the use of automatic drawing-in machines to draw in the warp threads. However, since the heddle frames are constantly oscillating, the supporting members of the heddle frames oscillate such that the distance between the upper and lower supporting members is not constant. For this reason the heddles on the heddle slide bars must be held with relatively large play, because otherwise they would be damaged as a consequence of the generated oscillations. The drawback of the required existing play is the damage to the heddles and the slide bars due to wear, such damage resulting due to the continuous relative movements between the heddles and the slide bars. These negative effects increase as the speed of the weaving machine increases, so that efforts to have the weaving machines function at higher speeds must be held within limits.

The known use of heddles engaged at only one end to the supporting member of the heddle frame has, in practice, proven unworkable, since it is not technically feasible to produce heddles for such a connection to the supporting member in very large quantities with the necessary precision.

German published application 20 41 082 discloses a heddle wherein only one end section thereof is attached to the supporting member of a heddle frame and is driven by it to form the shed. Such end section has a closed oblong hook which engages the slide bar with play. The opposed, free ends of the heddles are braced, however, by a pair of separate, opposing parallel guide bars.

SUMMARY OF THE INVENTION

In accordance with the invention, the aforementioned problems are avoided by the provision of a heddle that is held in such a manner with one end section at the supporting member of the heddle frame that the heddle is guided with very little play which is, nevertheless, sufficiently large to permit lateral movement of the heddle as required during the weaving operation, and that the warp threads can be automatically drawn in.

More particularly, the heddle of the invention has at one longitudinal edge thereof at least one groove-shaped opening for engaging the slide bar of the supporting member, such opening being sized slightly greater compared to the size of the slide bar for thereby attaching the element to the supporting member with relatively little play.

The heddle of the invention is driven only with such one end section and was an opposite terminal end that is not attached, so that all the problems ,caused in the past by oscillation and elastic deformations of heddle frames are eliminated and the need to attach the heddle with a relatively large amount of play is avoided.

Thus, the heddle has at one longitudinal edge thereof a groove-shaped opening similar to the previously known C-shaped end hooks to line up and engage the heddle slide bar on which the heddle is supported with little play. This little play that is necessary, especially for automatically drawing-in the warp threads, can facilitate, however, a lateral tilting of the heddles, which can have very undesired consequences, especially during the transport of the lined-up heddles from the weaving preparation to the weaving room, when the heddles and the warp threads intertwine. For this reason, the end section of the heddle attached to the supporting member of the heddle shaft may have at its longitudinal edge a second groove-shaped opening spaced from the thread eye of the heddle a distance greater than the distance at which the first groove-shaped opening is spaced therefrom. And, the supporting member has a second slide bar engageable by such second opening for further attaching the heddle to the supporting member at only the one end section thereof. Such second opening is sized greater compared to the size of the second slide bar for thereby further attaching the heddle to the supporting member thereat but with relatively large play. Therefore, the heddle can pivot somewhat to both sides through a limited angle. The greater play provided at the second groove-shaped opening allows for a quite inexpensive production of the heddles which need not be made with extreme accuracy.

Preferably, the heddles are long at their free, unattached ends, such that they are always guided between adjacent warp threads. In such manner, any tilting of the heddles to the side is limited. And, the heddles are also designed in such a manner that at such free end they can be used on currently available automatic drawing-in machines to draw-in the warp threads with only slight adjustments of such machines. Thus, the heddle end can be designed in such a manner that the shape matches the well-known conventional shapes of end hooks. To automatically draw-in the warp threads, such guide element can be designed on the free end of the heddle as a holding member for connecting to a locking element for holding together a plurality of heddles. For this purpose, the free ends of the heddles may have aligned holes for engagement with rod-shaped bodies provided as locking elements. Such a rod-shaped body extended through the holes in all the heddles prevents the heddles from mutually sagging relative to each other during operation. The free ends of the heddles can also have other various shapes, so long as the automatic drawing-in machine is adapted to the selected shape.

DETAILED DESCRIPTION OF THE INVENTION

Figure 1:
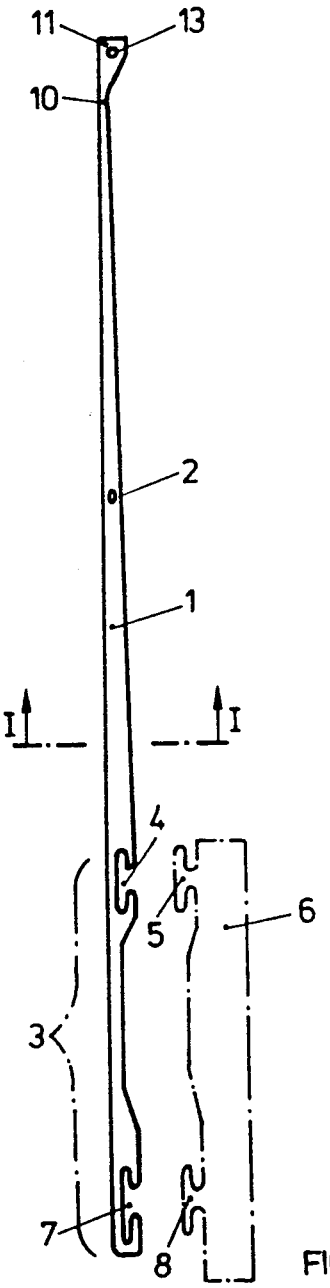
FIG. 1 is a side elevational view of the heddle according to the invention, showing a supporting member of a heddle frame in phantom outline.
Figure 7:
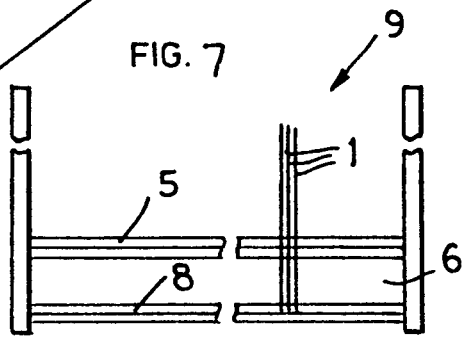
FIG. 7 is a front elevational view of a heddle frame with only one supporting member.

Turning now to the drawings wherein like reference numerals refer to like and corresponding parts throughout the several views, heddle 1 of FIG. 1 has at a predetermined distance from thread eye 2, a relatively wider end section 3. At such section, a longitudinal edge of the heddle, which comprises an elongated element, has a groove-shaped opening 4, which may be C-shaped, by means of which the heddle is supported on slide bar 5 of a supporting member 6 (shown in phanton outline in FIG. 1) of a heddle frame. Heddle frame 9 is shown in FIG. 7 as having only one supporting member 6 for supporting the plurality of the heddles 1.

Opening 4 is sized slightly greater compared to the size of slide bar 5 to thereby permit the heddle to be held on the supporting member with relatively little play. Nevertheless, the heddle has sufficient freedom of movement that the warp threads can be automatically drawn-in.

Opening 4 is located at a predetermined distance from thread eye 2, and the longitudinal edge of each heddle has a second groove-shaped opening (which may be C-shaped as shown) spaced from thread eye 2 a distance greater than such predetermined distance. Supporting member 6 has a second slide bar 8 engageable by opening 7 for further attaching the heddle to supporting member 6 at only one end section 3 thereof. Opening 7 is sized greater compared to the size of slide bar 8 for thereby further attaching the heddle to the supporting member but with relatively large play so that it can pivot somewhat, but only to a limited degree to the side. Such large play facilitates a less accurate and, therefore, a lower cost production of the interacting parts comprising the heddle and the supporting member.

Figure 2:
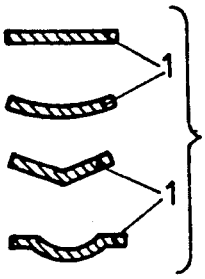
FIG. 2 is a view of several alternate cross-sectional shapes of the heddle taken substantially along the line 2—2 of FIG. 1.

In order for each heddle to be driven and held only at the lower end section without bending at higher stresses, particularly at the upper shed position due to inadequate inherent stability, the heddle has below thread eye 2 a preferably arcuate-shaped cross-section which, as shown in FIG. 2, can be of various shapes. With less stress, the cross-section can be flat as shown, and with higher stress the cross-section can be arcuate, V-shaped, or rounded off such that its central section is formed as a longitudinal bead. The inherent stability of the heddle as thereby increased allows for its use even with high warp thread stresses.

The heddle extends beyond thread eye 2 to free end 10 which is not driven and is not attached, and is of a sufficient length that even when the heddle is in the extreme position in the lower shed this terminal end 10 still projects somewhat over the adjacent warp threads lying above it in the upper shed, so that these warp threads can be used as a lateral guide for the respective heddle.

Moreover, free end 10 can provide an additional guide for the heddle, whose lateral freedom of movement is already restricted by auxiliary slide bar 8. The heddle is expanded at end 10 and forms a guide element 11 by means of which the warp threads can be drawn-in automatically on a special machine. Guide element 11 can be designed in different ways and can have, for example, a conventional end hook shape so that in order to use the currently available automatic drawing-in machines only minor adjustments of such machines are necessary. If more extensive adjustments of an existing drawing-in machine are acceptable or if a new construction of such a machine is contemplated, the terminal end of the heddle expanded into guide element 11 can be provided in any expedient shape which is simple to produce and which contributes little to the total weight of the heddle. Various embodiments of such a guide element 11 provided at the terminal end of each heddle are illustrated in FIGS. 3 to 6.

Figure 3:
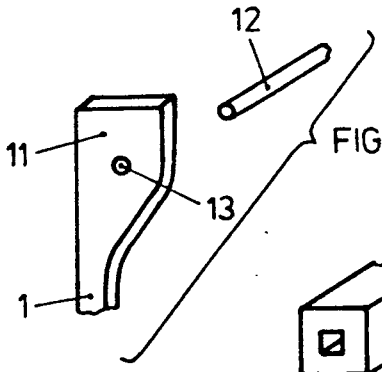
FIG. 3 is an expanded Perspective view of the free end of the heddle and a round rod provided as a locking element.

Besides the automatic drawing-in, the terminal end of the heddle expanded into a guide element 11 also functions simultaneously for another purpose of connecting all heddles present in a heddle shaft to a locking element which may be in the shape of a rod-shaped body. In such manner, the heddles are prevented from shuttling back and forth during the weaving operation, and from mutually catching and snagging at their free ends, a feature that otherwise would result in the warp threads breaking or in the destruction of the heddles. The rod-shaped body can, as shown in FIG. 3, be in the form of a round rod 12 which extends through and engages with an aligned opening or hole 13 in guide element 11 provided at all of the heddles.

Figure 4:
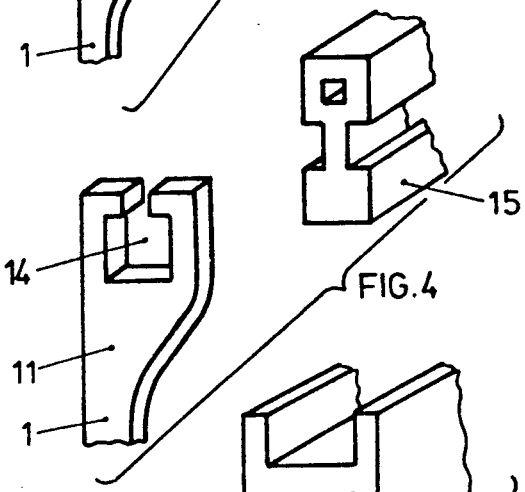
FIGS. 4, 5 and 6 are expanded perspective views of other embodiments of the free ends of the heddle and related rod-shaped bodies provided as locking elements for lining up the heddles.

As shown in FIG. 4, the guide element at the terminal end of the heddle is formed as a T-shaped slot or opening 14 into which a rod-shaped body 15 of a complementarily shaped cross-section extends.

Figure 5:
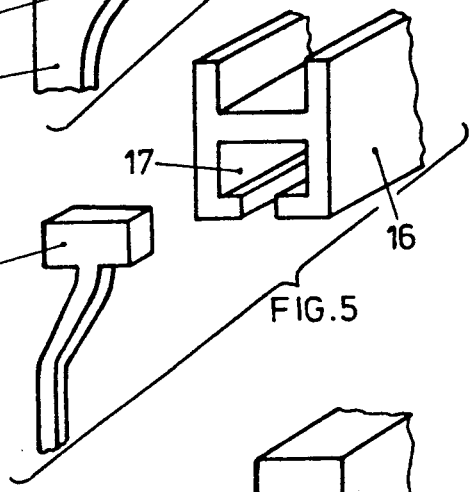

The complementary shapes for the guide element and the rod-shaped body can be reversed, as shown in FIG. 5, such that rod-shaped body 16 has a T-shaped slot 17 into which a T-shaped heddle end 11 fits.

Figure 6:
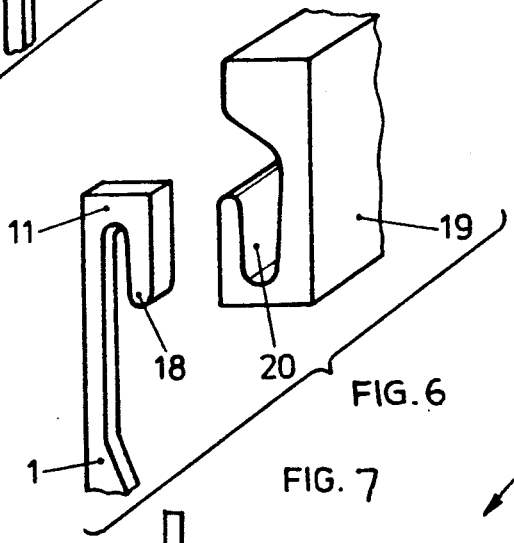

In the FIG. 6 embodiment, the heddle has a hook-shaped end 18 similar to a conventional end hook, and rod-shaped body 19 has a longitudinal channel 20 suitable for engaging with hook ends 18 of the heddles, channel 20 extending in a longitudinal direction of body 19. The terminal end of the heddle designed as a guide element 11 can also have other shapes suitable for automatically drawing-in warp threads.

Obviously, many other modifications and variations of the present invention are made possible in the light of the above teachings. It is therefore to be understood that within the scope of the appended claims the invention may be practiced otherwise than as specifically described.

What is claimed is:

1. In a heddle frame heddles each having at least one thread eye for the shed formation on a weaving machine carried out by a plurality of oscillatory heddle frames which support the heddles, each of the heddle frames having only a single heddle supporting member which is driven by the respective heddle frame thereof to form the shed, the supporting member having a first slide bar, each of the heddles comprising an elongated element attached to the supporting member at only one single end section of each said heddle, one longitudinal edge of each said element having a first groove-shaped opening at said one end section engageable with said first slide bar of the supporting member, said opening being sized slightly greater compared to the size of said first slide bar for thereby attaching said element to the supporting member with relatively little play, said opening being located a predetermined distance from said thread eye, said longitudinal edge of each said elongated element having a second groove-shaped opening spaced from said thread eye a distance greater than said predetermined distance, the supporting member having a second slide bar engageable by said second opening for further attaching said element to the supporting member at said one single end section.

2. The heddles according to claim 1, wherein an end of each said element opposite said one end section has a guide element.

3. The heddles according to claim 2, wherein each said guide has means for engaging a locking element provided for holding each said opposite end together for preventing any mutual snagging thereof.

4. The heddles according to claim 3, wherein said engaging means comprises a guide opening, and said locking element comprises a rod-shaped body engageable with said guide opening.

5. The heddles according to claim 3, wherein said engaging means comprises a bar, and said locking element comprises a rod-shaped body having a slot engageable with said bar.

6. The heddles according to claim 3, wherein said engaging means comprises a hook end, and said locking element comprises a rod-shaped body having a channel engageable with said hook end.

7. The heddles according to claim 1, wherein each said element has, in the region between said thread eye and said one opening, a non-flat cross-section for increasing the stability of each said heddle.

8. The heddles according to claim 1, wherein said second opening is sized greater compared to the size of said second slide bar for thereby further attaching said element to the supporting member thereat with relatively large play.

* * * * *